US007161078B2

(12) United States Patent
Becker-Ehmck

(10) Patent No.: US 7,161,078 B2
(45) Date of Patent: Jan. 9, 2007

(54) BASS MALLET PERCUSSION INSTRUMENT

(75) Inventor: Bernd Becker-Ehmck, Lochham (DE)

(73) Assignee: Studio 49 Musikinstrumentenbau GmbH, Gröfelfing (DE)

( * ) Notice: Subject to any disclaimer, the term of this patent is extended or adjusted under 35 U.S.C. 154(b) by 0 days.

(21) Appl. No.: 11/397,044

(22) Filed: Apr. 3, 2006

(65) Prior Publication Data

US 2006/0236843 A1 Oct. 26, 2006

(30) Foreign Application Priority Data

Apr. 6, 2005 (DE) ..... 10 2005 015 811

(51) Int. Cl.
*G10D 13/08* (2006.01)

(52) U.S. Cl. ..... 84/410; 84/402; 84/403; 84/404; 84/405; 84/406; 84/407

(58) Field of Classification Search ..... 84/397–407, 84/410
See application file for complete search history.

(56) References Cited

U.S. PATENT DOCUMENTS 747,341 A * 12/1903 Deagan ..... 84/403
1,192,324 A * 7/1916 Kohler ..... 84/403
1,283,774 A * 11/1918 Hope-Jones ..... 84/403
1,291,778 A * 1/1919 Deagan ..... 84/403
1,293,723 A * 2/1919 Deagan ..... 84/410
1,369,268 A * 2/1921 Deagan ..... 84/410
2,287,138 A * 6/1942 Sas ..... 84/410
2,347,287 A * 4/1944 Sas ..... 84/403
3,595,119 A * 7/1971 Kuijpers ..... 84/403
3,705,527 A * 12/1972 Burnham ..... 84/403
3,858,477 A * 1/1975 Kawakami ..... 84/410
4,111,094 A * 9/1978 Broser ..... 84/402
4,411,187 A * 10/1983 Roper et al. ..... 84/402
4,903,563 A * 2/1990 Mizuguchi ..... 84/723
5,686,679 A * 11/1997 Nakano et al. ..... 84/402
6,127,611 A * 10/2000 VansEvers ..... 84/294

* cited by examiner

*Primary Examiner*—Lincoln Donovan
*Assistant Examiner*—Robert W. Horn
(74) *Attorney, Agent, or Firm*—Jaspan Schlesinger Hoffman LLP; Lee Grosskreuz Hechtel

(57) ABSTRACT

This disclosure relates to a bass mallet percussion instrument which is physically compact as compared to previous instruments, where percussion bars are removeably fixed above a resonance box that is divided into a plurality of resonance spaces, and the resonance s spaces are delineated from each other by separating walls.

5 Claims, 4 Drawing Sheets

BASS MALLET PERCUSSION INSTRUMENT

Figure 1:
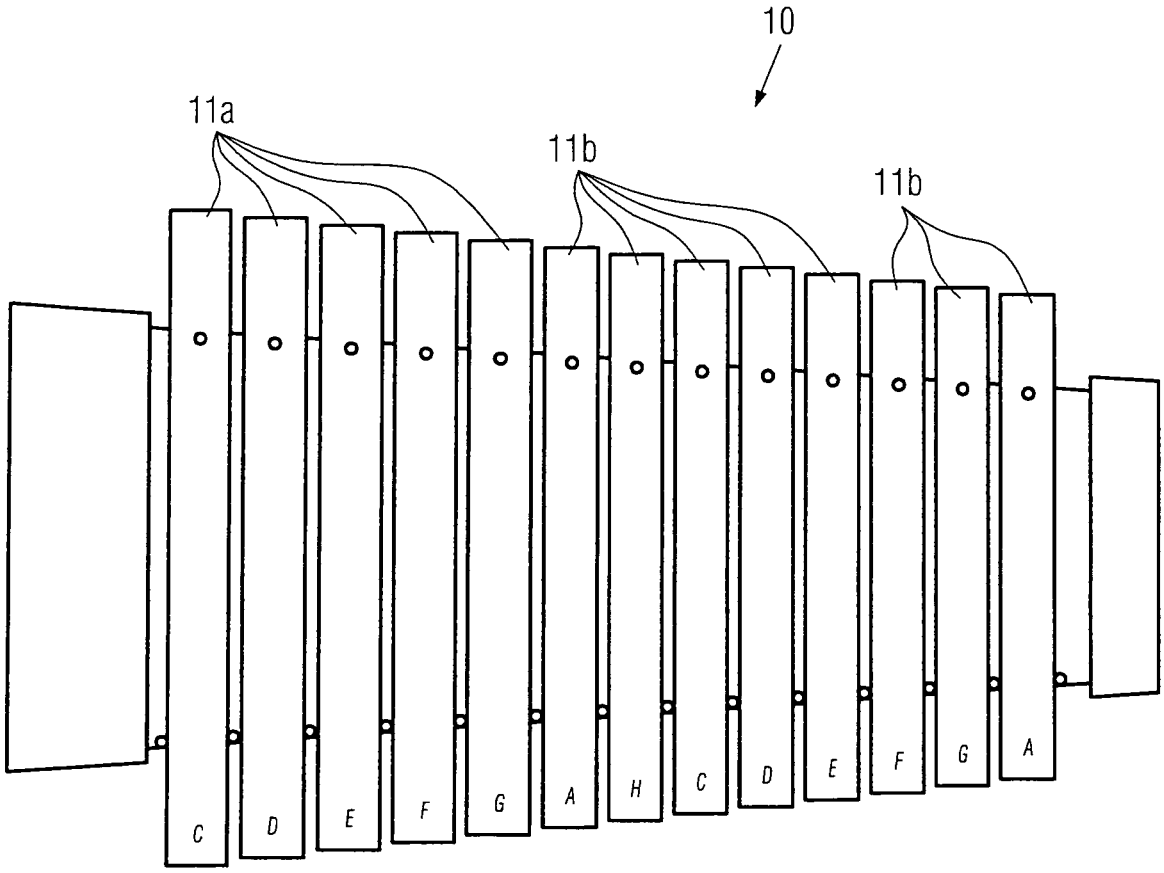

The invention relates to a bass mallet percussion instrument having bars and a resonance box, whereby anchored in its side walls are receiving pins for bars, and the resonance box is divided into a plurality of resonance spaces that are delimited from one another by vertical separating walls, of which resonance spaces each is allocated to one or a plurality of bars.

As a rule, mallet percussion instruments such as xylophones and metallophones require a large resonance volume in the bass range in order to be able to radiate the low pitches with sufficient robustness of sound. This necessarily leads to such instruments being quite large. On the other hand, instruments used during instruction in school frequently must be moved between rooms so that smaller instruments that are easier to handle would be advantageous. Smaller instruments would furthermore be advantageous with respect to storage space, both in manufacturing and in commerce.

The present invention relates to a mallet percussion instrument having so-called classical construction, whereby the receiving pins for the bars are anchored or attached in the walls of the resonance box.

Conventional bass mallet percussion instruments are furthermore structurally complex in that for attaining optimum sound volume the individual resonance boxes must be adapted to the bars, so that sometimes each individual resonance space has a different height or in addition inserts that reduce the size of the space are provided in the interior of the resonance spaces. This clearly increases the structural complexity of such an instrument when there are stringent demands placed on sound quality for the instrument.

The basic object of the invention is to provide an instrument that is structurally more compact than conventional bass mallet percussion instruments having a classical structure.

This object is attained using the combination of features cited in claim 1.

The invention is in particular characterized by a combination of three features, specifically the allocation of three bars to a second resonance space of a plurality of successive resonance spaces, the use of wider (and also thicker) bars in the region of the two aforesaid resonance spaces, and the arrangement of cover plates on the first two resonance spaces.

The width of the resonance box in the classical structure is largely prescribed by the length of the individual bars and/or their nodes for affixing. As is known, the length of the bars is largely a function of their material strength and thus cannot be changed significantly.

It was inventively determined that primarily the third and fourth pitch are decisive for the volume of a mallet percussion instrument, that the dimensions of the resonance chambers are prescribed on the one hand by the width of the bar and on the other hand by the placement of the bars on the nodes. Thus, only the height of the resonance space is variable for a given bar length and bar width. The lower the pitch, the larger the resonance space required and vice versa. In order on the one hand to configure the resonance space as large as possible for the sound volume and on the other hand to keep the structural height as small as possible, it is inventively suggested that the third, fourth, and fifth bars be combined on one resonance chamber. This means an aggregate total of less resonance space than the total of the required individual resonance spaces.

Although it is known per se to combine the third through fifth pitch on one resonance chamber, it is furthermore inventively suggested to provide each of the first two resonance spaces with a cover plate, which correspondingly increases the acoustic pressure. In particular when a cover plate with an appropriately dimensioned sound hole for the second resonance chamber is added, the volume of the second resonance chamber and thus the structural height of the entire instrument can be significantly reduced.

One additional essential advantage is that using the inventive combination the first three resonance chambers can be adapted to one another such that they can have the same height, which makes it possible to have a uniformly tall floor for the first three resonance chambers. This reduces the structural complexity of the inventive instrument.

Using this combination of features, the inventive bass mallet percussion instrument can be reduced in structural volume by about 40% compared to conventional instruments without having to make the slightest concessions with respect to the sound quality of the instrument.

By using narrower bars from about the third resonance space, the entire length of the instrument and thus also the structural volume can be further reduced without thereby noticeably limiting the playability of the instrument. It should be noted that it is most sensible for the bars of the first and second resonance spaces to have the greater width and the other bars to have the narrower width. Alternatively, it is also possible to displace somewhat the jump from the wider to narrower bars, that is, to embody only the first four or the first six bars wider than the other bars.

Preferably the wider bars have width of about 35 to 40 mm, while the other, narrower bars have a width of 30 to 35 mm.

In order to even further improve the fullness of sound for low pitches, the wider bars are preferably 10 to 25% taller than the narrower bars. In xylophones with wooden bars, the height of the wider bars is 18 to 23 mm, while that of the narrower bars is 16 to 21 mm. In a metallophone with metal bars, the height of the wider bars is 9 to 12 mm, while that of the narrower bars is 7 to 9 mm.

It is particularly preferred for the first three resonance chambers to have a common floor plate, which is only possible using the inventive combination of features in accordance with claim 1. This clearly permits the manufacturing complexity to be reduced compared to conventional mallet percussion instruments having the classical construction in which each resonance space has its own floor or even complex inserts.

The invention is explained in greater detail in the following using the enclosed drawings.

Figure 2:
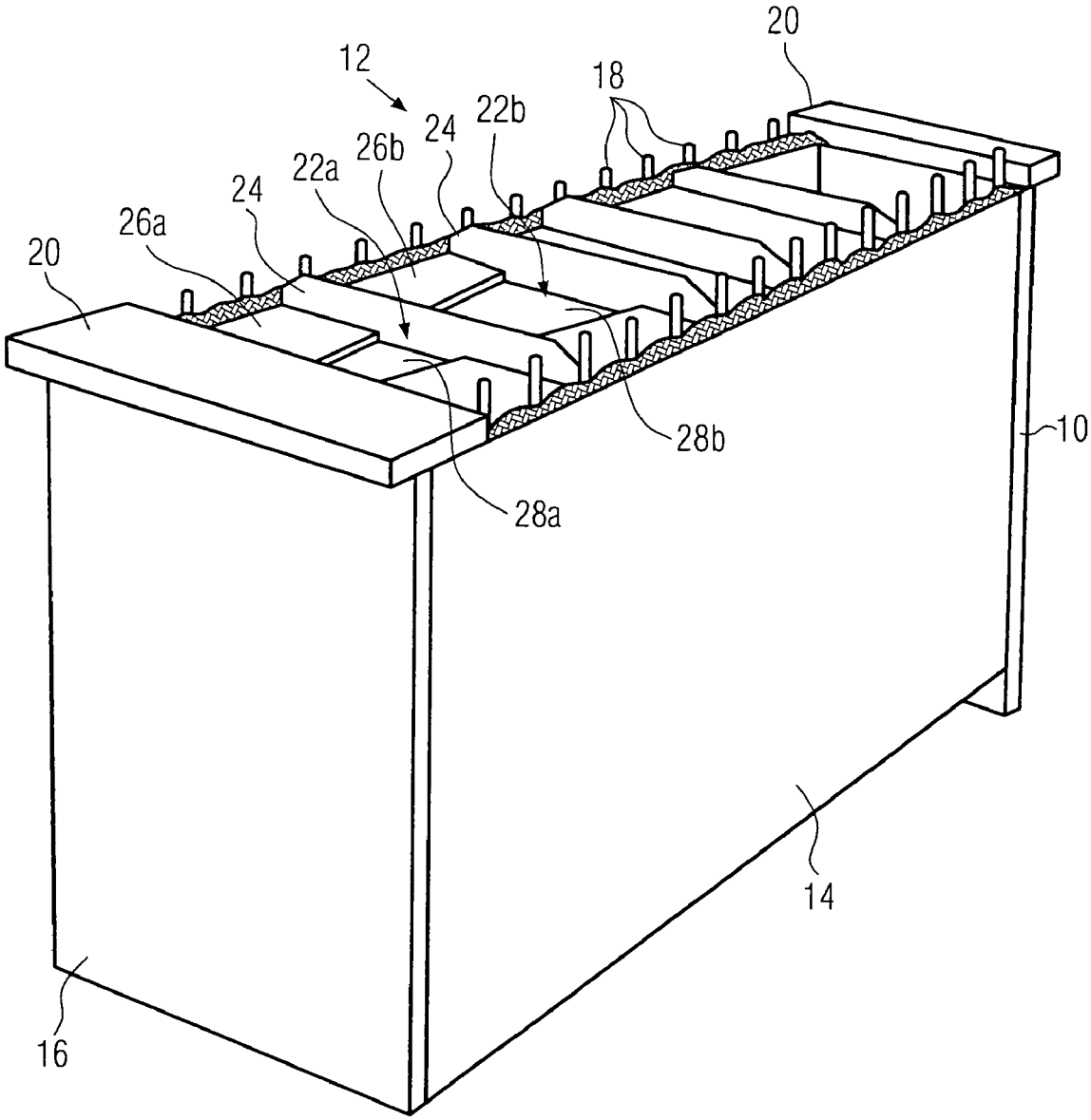
Figure 3:
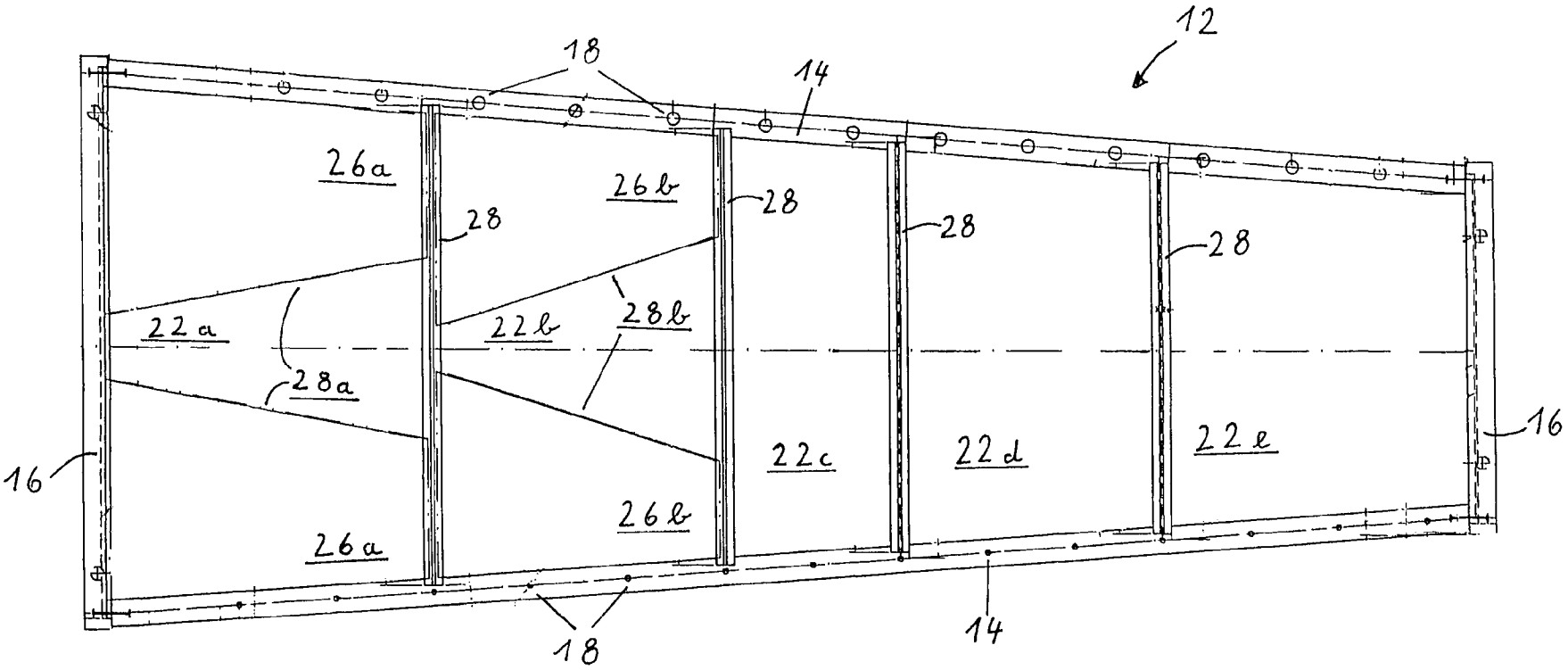
Figure 4:
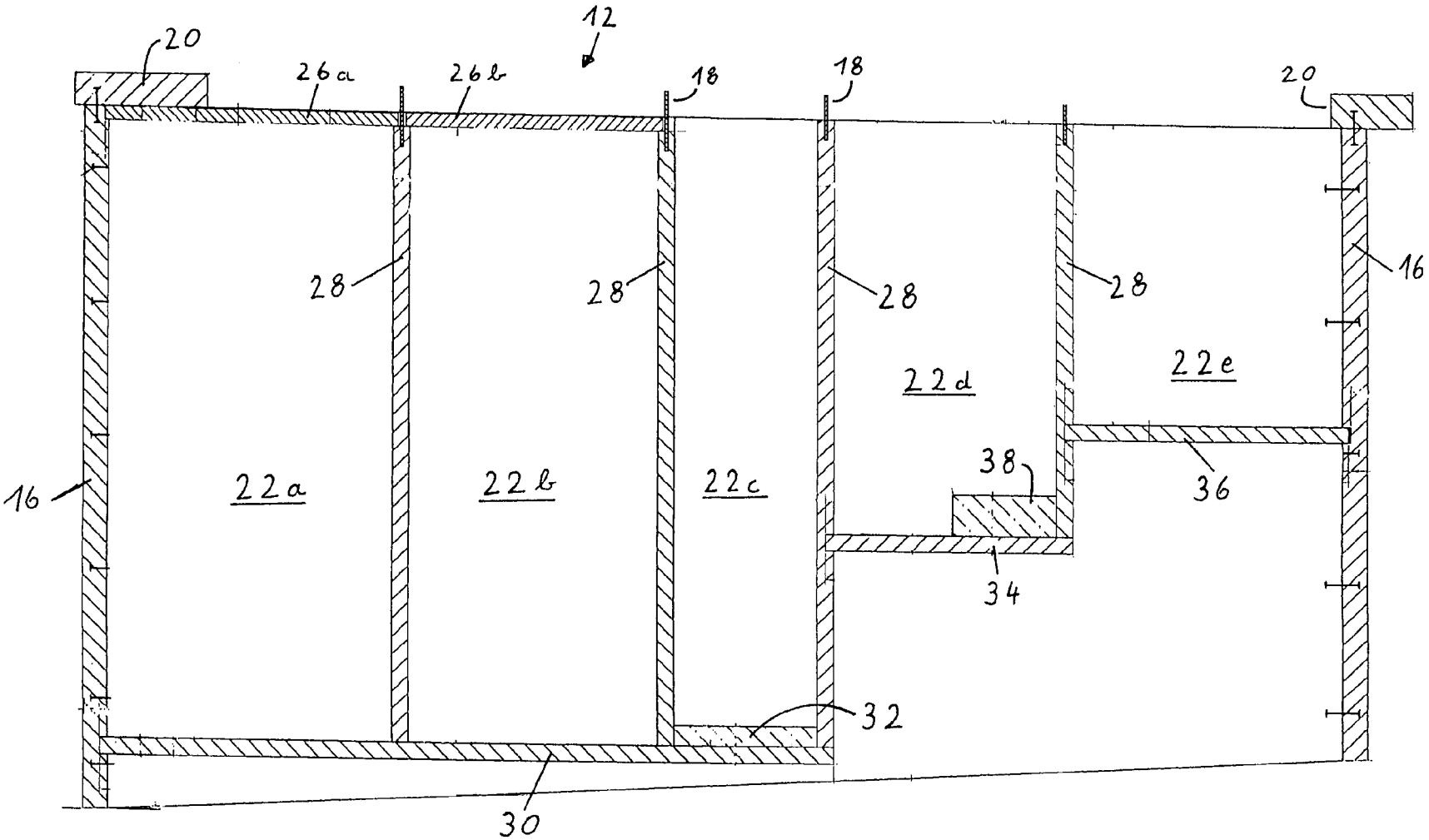

FIG. 1: is a top view of a bass xylophone;

FIG. 2: is a perspective elevation of the resonance chamber of a bass xylophone;

FIG. 3: is a top view of the resonance box of the bass xylophone in accordance with FIG. 2; and, FIG. 4: is a longitudinal section through the resonance box of the instrument in accordance with FIGS. 2 and 3.

FIG. 1 depicts a top view of a bass xylophone 10 with a number of wider bars 11*a* and another number of narrower bars 11*b*.

The resonance box 12, depicted in a perspective elevation in FIG. 2, of a bass xylophone without bars 11 positioned thereon includes side walls 14, end walls 16, pins 18 that are affixed in the side walls 14 and that are for the bars that are not illustrated, and end plates 20 joined to the end walls 16. Attached between two first resonance spaces 22*a* and 22*b* and additional resonance spaces are separating panels 24 that project into the intermediate space between adjacent bars in order to bound off the individual resonance spaces from one another.

The first two resonance spaces 22*a* and 22*b* have cover plates 26*a* and 26*b*, while the other resonance spaces are open to the top. The two cover plates 26*a* and 26*b* of the first two resonance spaces 22*a* and 22*b* furthermore have trapezoidal sound holes 28*a* and 28*b*.

The resonance box 12 can be seen in a top view and in a longitudinal section in FIGS. 3 and 4, respectively. In FIG. 3, the resonance spaces 22*a* and 22*b* for the first two or next three bars are illustrated, as are the three further resonance spaces 22*c*, 22*d*, 22*e*, which are separated from one another by separating walls 28. The separating panels 24 illustrated in FIG. 2 are attached to these separating walls 28. The cover plates 26*a* and 26*b* of the resonance spaces 22*a* and 22*b* having the trapezoidal sound holes 28*a* and 28*b* are likewise depicted.

The pins 18 for the bars (not shown) can be seen in FIG. 3. The position of each of the bars with respect to the resonance spaces 22 results from this.

In the longitudinal section in accordance with FIG. 4 it is furthermore possible to see that the first three resonance spaces 22*a*, 22*b*, and 22*c* have a common floor plate 30. An insert 32 is added in the third resonance space 22*c* in order to reduce the volume of this third resonance space 22*c*. Due to the necessarily smaller volume the other resonance spaces 22*d* and 22*e* have floor plates 34 and 36 that are placed higher, whereby another volume reducing insert 38 is added in the resonance space 22*d*.

What is claimed is:

1. Bass mallet percussion instrument having bars and a resonance box (12), whereby anchored in its side walls (14) are receiving pins (18) for bars, and said resonance box (12) is divided into a plurality of resonance spaces (22) that are delimited from one another by vertical separating walls (28), of which resonance spaces each is allocated to one or a plurality of bars, characterized by the following features:

(a) a first resonance space (22*a*) is allocated to the two lower-most bars and a second resonance space (22*b*) is allocated to the subsequent three bars;

(b) the bars (11*a*) that are essentially allocated to said first and second resonance spaces (22*a*, 22*b*) have a width that is 10–30% wider than the other bars (11*b*);

(c) said first and second resonance spaces (22*a*, 22*b*) are each provided with a cover plate (26*a*, 26*b*), each of which has a sound hole (28*a*, 28*b*).

2. Bass mallet percussion instrument in accordance with claim 1, characterized in that said bars (11*a*) allocated to said first and second resonance spaces (22*a*, 22*b*) have a width of 35–40 mm, while said other bars (11*b*) have a width of 30–35 mm.

3. Bass mallet percussion instrument in accordance with claim 1, characterized in that said wider bars (11*a*) are 10–30% taller than said narrower bars (11*b*).

4. Bass mallet percussion instrument in accordance with claim 1, characterized in that said first, said second, and a subsequent third resonance space (22*a*, 22*b*, 22*c*) have a common floor plate (30).

5. Bass mallet percussion instrument in accordance with claim 1, characterized in that said sound holes (28) have trapezoidal cross-sections.

* * * * *